US010203617B2

(12) United States Patent
Kuno et al.

(10) Patent No.: US 10,203,617 B2
(45) Date of Patent: Feb. 12, 2019

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Jumpei Kuno, Yokohama (JP); Takashi Anezaki, Hiratsuka (JP); Taichi Sato, Numazu (JP); Kenichi Kaku, Suntou-gun (JP); Atsushi Fujii, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/895,148

(22) Filed: Feb. 13, 2018

(65) Prior Publication Data

US 2018/0246425 A1 Aug. 30, 2018

(30) Foreign Application Priority Data

Feb. 28, 2017 (JP) ..... 2017-037015

(51) Int. Cl.

| | |
|---|---|
| ***G03G 5/14*** | (2006.01) |
| ***G03G 5/06*** | (2006.01) |
| ***G03G 5/04*** | (2006.01) |

(52) U.S. Cl.

CPC ..... *G03G 5/144* (2013.01); *G03G 5/04* (2013.01); *G03G 5/0696* (2013.01); *G03G 2215/00957* (2013.01)

(58) Field of Classification Search

CPC ..... G03G 5/144; G03G 5/0696; G03G 2215/00957

See application file for complete search history.

(56) References Cited

U.S. PATENT DOCUMENTS

| | | | |
|---|---|---|---|
| 6,773,856 | B2 | 8/2004 | Tanaka et al. |
| 6,994,941 | B2 | 2/2006 | Tanaka et al. |

(Continued)

FOREIGN PATENT DOCUMENTS

| | | | |
|---|---|---|---|
| JP | H04-294363 | A | 10/1992 |
| JP | H07-287475 | A | 10/1995 |

(Continued)

OTHER PUBLICATIONS

Machine Translation of JP2007-298568 (A, B), dated Nov. 15, 2007.*

U.S. Appl. No. 15/901,128, Jumpei Kuno, filed Feb. 21, 2018.

*Primary Examiner* — Thorl Chea

(74) *Attorney, Agent, or Firm* — Venable LLP

(57) ABSTRACT

Provided is an electrophotographic photosensitive member which can simultaneously achieve less occurrence of leakage and the definition of an output image even when being an electrophotographic photosensitive member where a layer containing a metal oxide particle is adopted as an electroconductive layer, and which includes a support, an electroconductive layer and a photosensitive layer in this order, wherein the electroconductive layer contains a binder material and a particle represented by general formula (1):

$$TiO_{2.00-X}N_Y \quad (1)$$

wherein Ti represents a titanium atom, O represents an oxygen atom, N represents a nitrogen atom and $0.00<Y<X\leq 0.60$ is satisfied.

9 Claims, 4 Drawing Sheets

(56) References Cited

U.S. PATENT DOCUMENTS

| | | | |
|---|---|---|---|
| 7,045,261 | B2 | 5/2006 | Tanaka et al. |
| 7,245,851 | B2 | 7/2007 | Fujii et al. |
| 7,333,752 | B2 | 2/2008 | Kawahara et al. |
| 7,517,626 | B2 | 4/2009 | Fujii et al. |
| 7,556,901 | B2 | 7/2009 | Anezaki et al. |
| 7,910,274 | B2 | 3/2011 | Tanaka et al. |
| 7,927,774 | B2 | 4/2011 | Ogaki et al. |
| 8,088,541 | B2 | 1/2012 | Tanaka et al. |
| 8,455,170 | B2 | 6/2013 | Nakamura et al. |
| 8,538,298 | B2 | 9/2013 | Harada et al. |
| 8,669,027 | B2 | 3/2014 | Anezaki et al. |
| 8,753,789 | B2 | 6/2014 | Ogaki et al. |
| 8,778,580 | B2 | 7/2014 | Tsuji et al. |
| 8,783,209 | B2 | 7/2014 | Kaku et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 8,980,510 | B2 | 3/2015 | Fujii et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,069,267 | B2 | 6/2015 | Kaku et al. |
| 9,075,333 | B2 | 7/2015 | Uematsu et al. |
| 9,098,006 | B2 | 8/2015 | Uematsu et al. |
| 9,158,213 | B2 | 10/2015 | Taniguchi et al. |
| 9,164,406 | B2 | 10/2015 | Nishi et al. |
| 9,188,888 | B2 | 11/2015 | Okuda et al. |
| 9,256,145 | B2 | 2/2016 | Fujii et al. |
| 9,256,153 | B2 | 2/2016 | Aoyama et al. |
| 9,274,442 | B2 | 3/2016 | Sato et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,448,502 | B2 | 9/2016 | Taniguchi et al. |
| 9,523,929 | B2 | 12/2016 | Nakamura et al. |
| 9,563,139 | B2 | 2/2017 | Kawahara et al. |
| 9,599,914 | B2 | 3/2017 | Uematsu et al. |
| 9,599,915 | B2 | 3/2017 | Anezaki et al. |
| 9,599,917 | B2 | 3/2017 | Okuda et al. |
| 9,645,516 | B2 | 5/2017 | Kawahara et al. |
| 9,645,517 | B2 | 5/2017 | Sato et al. |
| 9,726,992 | B2 | 8/2017 | Sakuma et al. |
| 9,851,646 | B2 | 12/2017 | Tomono et al. |
| 9,869,032 | B2 | 1/2018 | Kawahara et al. |
| 2012/0076539 | A1 | 3/2012 | Sato et al. |
| 2014/0004450 | A1 | 1/2014 | Tokimitsu et al. |
| 2015/0346617 | A1 | 12/2015 | Kawahara et al. |
| 2015/0362847 | A1 | 12/2015 | Tanaka et al. |
| 2018/0024460 | A1 | 1/2018 | Uematsu et al. |

FOREIGN PATENT DOCUMENTS

| | | | |
|---|---|---|---|
| JP | 2002-107984 | A | 4/2002 |
| JP | 2007-298568 | A | 11/2007 |
| JP | 2007-298569 | A | 11/2007 |
| JP | 2007-334334 | A | 12/2007 |

* cited by examiner

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus including the electrophotographic photosensitive member.

Description of the Related Art

In recent years, an electrophotographic photosensitive member (organic electrophotographic photosensitive member) using an organic photoconductive material has been actively researched and developed.

The electrophotographic photosensitive member is basically configured from a support, and a photosensitive layer formed on the support. Currently, however, various layers are often provided between the support and the photosensitive layer for the purposes of, for example, hiding of defects on the surface of the support, protection of the photosensitive layer from electrical breakage, an enhancement in chargeability and an improvement in charge injection inhibition properties from the support to the photosensitive layer.

Among layers provided between the support and the photosensitive layer, a layer containing a metal oxide particle is known as a layer provided for the purpose of hiding defects on the surface of the support. A layer containing a metal oxide particle is commonly higher in electroconductivity than a layer containing no metal oxide particle, and therefore hardly causes an increase in residual potential during image formation and hardly causes variations in dark portion potential and light portion potential. Such a layer high in electroconductivity (hereinafter, referred to as "electroconductive layer") is provided between the support and the photosensitive layer to hide defects on the surface of the support, thereby increasing the acceptable level of defects on the surface of the support. As a result, the region of the support to be acceptably used is significantly extended, and therefore an advantage is that an enhancement in productivity of the electrophotographic photosensitive member is achieved.

In addition, an increase in definition of an output image by electrophotography has been recently advanced. It is known to be effective for an increase in definition of an output image to decrease the irradiation spot size of image exposure light and to decrease the size of a toner particle. In addition thereto, it is known that the degree of definition of an output image can be varied even by the electrophotographic photosensitive member.

Japanese Patent Application Laid-Open No. H4-294363 describes an electrophotographic photosensitive member containing a titanium oxide particle, subjected to ammonia reduction, in an electroconductive layer. Japanese Patent Application Laid-Open No. H7-287475 and Japanese Patent Application Laid-Open No. 2007-334334 describe an electrophotographic photosensitive member containing an oxygen-deficient titanium oxide particle in an electroconductive layer and a layer in which an electroconductive particle is dispersed. Japanese Patent Application Laid-Open No. 2007-298568 and Japanese Patent Application Laid-Open No. 2007-298569 describe an electrophotographic photosensitive member containing a nitrogen-doped titanium oxide particle in an intermediate layer. Japanese Patent Application Laid-Open No. 2002-107984 describes an electrophotographic photosensitive member containing a titanium dioxide particle in a first intermediate layer (corresponding to the electroconductive layer in the present application).

SUMMARY OF THE INVENTION

The present inventors have made studies, and have found that, if image formation by the electrophotographic photosensitive member described in each of Japanese Patent Application Laid-Open No. H4-294363, Japanese Patent Application Laid-Open No. H7-287475, Japanese Patent Application Laid-Open No. 2007-334334, Japanese Patent Application Laid-Open No. 2007-298568 and Japanese Patent Application Laid-Open No. 2007-298569 is repeatedly performed under a low-temperature and low-humidity environment, leakage easily occurs in the electrophotographic photosensitive member. The leakage refers to a phenomenon where insulation breakdown occurs at a local portion of the electrophotographic photosensitive member to cause an excessive current to flow into the portion. The occurrence of leakage can cause the electrophotographic photosensitive member not to be sufficiently charged, leading to image failures such as a black point, a lateral white streak and a lateral black streak.

In addition, the electrophotographic photosensitive member described in Japanese Patent Application Laid-Open No. 2002-107984 has room for improvement in the definition of an output image.

Accordingly, an object of the present invention is to provide an electrophotographic photosensitive member that can simultaneously achieve less occurrence of leakage and the definition of an output image even when being an electrophotographic photosensitive member where a layer containing a metal oxide particle is adopted as an electroconductive layer.

The object is achieved by the following present invention. That is, the electrophotographic photosensitive member according to the present invention is an electrophotographic photosensitive member including a support, an electroconductive layer and a photosensitive layer in this order, wherein the electroconductive layer contains a binder material and a particle represented by general formula (1):

$$TiO_{2.00-X}N_Y \quad (1)$$

wherein Ti represents a titanium atom, O represents an oxygen atom, N represents a nitrogen atom and $0.00<Y<X\leq 0.60$ is satisfied.

The present invention also relates to a process cartridge that integrally supports the electrophotographic photosensitive member, and at least one unit selected from a charging unit, a developing unit, a transfer unit and a cleaning unit and that is detachably mountable on a main body of an electrophotographic apparatus.

The present invention also relates to an electrophotographic apparatus including the electrophotographic photosensitive member, and a charging unit, an exposure unit, a developing unit and a transfer unit.

The present invention can provide an electrophotographic photosensitive member that can simultaneously achieve less occurrence of leakage and the definition of an output image even when being an electrophotographic photosensitive member where a layer containing a metal oxide particle is adopted as an electroconductive layer.

Further features of the present invention will become apparent from the following description of exemplary embodiments with reference to the attached drawings.

DESCRIPTION OF THE EMBODIMENTS

Figure 1:
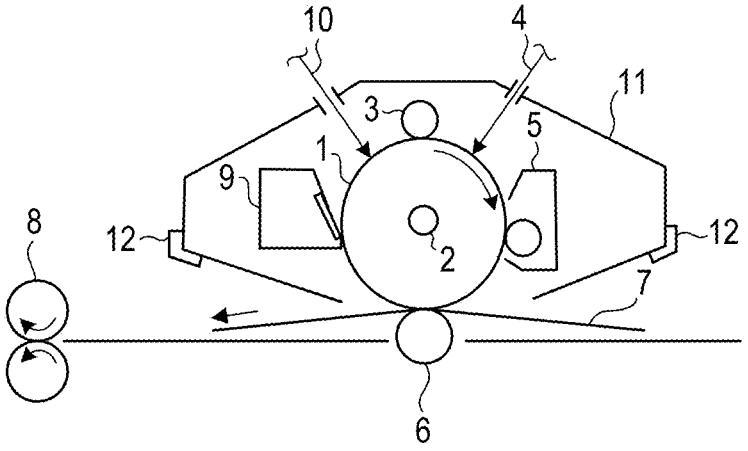
FIG. 1 is a view illustrating one example of a schematic configuration of an electrophotographic apparatus including a process cartridge including an electrophotographic photosensitive member.

Preferred embodiments of the present invention will now be described in detail in accordance with the accompanying drawings.

The present inventors have made studies, and thus have found that the conventional arts described in Japanese Patent Application Laid-Open No. H4-294363, Japanese Patent Application Laid-Open No. H7-287475, Japanese Patent Application Laid-Open No. 2007-334334, Japanese Patent Application Laid-Open No. 2007-298568 and Japanese Patent Application Laid-Open No. 2007-298569 cannot form an electroconductive layer having a proper electric resistance and therefore image formation is repeatedly performed under a low-temperature and low-humidity environment to thereby cause leakage to easily occur in an electrophotographic photosensitive member.

In addition, it is known that image exposure light which enters a photosensitive layer of an electrophotographic photosensitive member can be reflected at the interface with an underlying layer (layer present, which the image exposure light passing through the photosensitive layer is to enter) of the photosensitive layer or with a support and at the same time scattered in the underlying layer of the photosensitive layer. The present inventors have made studies, and thus have found that the conventional art described in Japanese Patent Application Laid-Open No. 2002-107984 causes the following technical problem: the above reflection and scattering cause a region of the photosensitive layer, irradiated with the image exposure light, to be substantially expanded to thereby deteriorate the definition of a latent image, resulting in deterioration in the definition of an output image.

In order to solve the technical problems caused in the conventional arts, the present inventors have made studies about a particle (hereinafter, also referred to as "metal oxide particle") for use in an electroconductive material of an electroconductive layer. As a result of such studies, it has been found that the technical problems caused in the conventional arts can be solved by using a particle represented by the following general formula (1):

$$TiO_{2.00-X}N_Y \quad (1)$$

wherein Ti represents a titanium atom, 0 represents an oxygen atom, N represents a nitrogen atom and $0.00<Y<X\leq 0.60$ is satisfied.

In the present invention, a titanium oxide particle included in the electroconductive layer includes not only a nitrogen-doped portion, but also an oxygen-deficient portion. On the other hand, a case where only a nitrogen-doped portion is included and no oxygen-deficient portion is included (Japanese Patent Application Laid-Open No. 2007-298568 and Japanese Patent Application Laid-Open No. 2007-298569 above) corresponds to a case where $X=Y$ in formula (1) is satisfied, and a case where no nitrogen-doped portion is included and only an oxygen-deficient portion is included (Japanese Patent Application Laid-Open No. H7-287475 and Japanese Patent Application Laid-Open No. 2007-334334 above) corresponds to a case where $Y=0$ in formula (1) is satisfied. Both cases cannot exert any effect of the present invention. Such a difference is presumed by the present inventors as follows.

In the present invention, titanium oxide has an oxygen-deficient portion and a nitrogen-doped portion, thereby exhibiting electrical properties and optical properties different from those of titanium oxide not reduced, and as a result, has a suitable resistance for use in the electroconductive layer. Furthermore, optical changes of image exposure light occur which include a reduction in refractive index and an increase in absorption rate, and as a result, the electroconductive layer is decreased in reflection and scattering from an underlying layer of the photosensitive layer, to inhibit a region of the photosensitive layer, irradiated with image exposure light, from being expanded, resulting in an increase in the definition of a latent image and an increase in the definition of an output image.

On the other hand, when titanium oxide high in reduction rate ($X>0.60$) is used, leakage resistance cannot be sufficiently improved. A high reduction rate causes a particle low in powder resistance to be formed, and the amount of a charge which flows into one electroconductive path in an electroconductive layer formed from the particle is increased. As a result, an excessive current easily flows locally.

Respective components can be synergistically affected by each other as described in the above mechanism, thereby allowing the effect of the present invention to be achieved.

[Electrophotographic Photosensitive Member]

The electrophotographic photosensitive member of the present invention includes a support, an electroconductive layer and a photosensitive layer.

Examples of the method for producing the electrophotographic photosensitive member of the present invention include a method including preparing a coating liquid for each layer, described below, performing coating in desired layer order and drying the resultant. Examples of the coating method of the coating liquid here include dip coating, spray coating, inkjet coating, roll coating, die coating, blade coating, curtain coating, wire bar coating and ring coating. In particular, dip coating can be adopted in terms of efficiency and productivity. Hereinafter, the support and respective layers will be described.

<Support>

In the present invention, the electrophotographic photosensitive member includes a support. In the present invention, the support can be an electroconductive support having electroconductivity. Examples of the shape of the support include a cylindrical shape, a belt shape and a sheet shape. In particular, a cylindrical support can be adopted. The surface of the support may also be subjected to an electrochemical treatment such as anodization, a blasting treatment, a centerless polishing treatment, a cutting treatment or the like.

The material of the support can be a metal, a resin, glass or the like.

Examples of the metal include aluminum, iron, nickel, copper, gold and stainless steel, and alloys thereof. In particular, an aluminum support using aluminum can be adopted.

The resin or glass may also have electroconductivity imparted by a treatment such as mixing of an electroconductive material or covering with such a material.

<Electroconductive Layer>

In the present invention, an electroconductive layer is provided on the support. The electroconductive layer can be provided to thereby hide scratches and/or irregularities on the surface of the support, and/or control reflection of light on the surface of the support. The electroconductive layer in the present invention contains a particle represented by general formula (1), and a binder material.

The particle represented by general formula (1) in the present invention is obtained by heating and reducing titanium dioxide (compositional formula: $TiO_2$) in an ammonia gas atmosphere. As the titanium dioxide, one having any of various shapes such as a spherical shape, a polyhedral shape, an ellipsoidal shape, a flake shape and a needle shape can be used. In particular, the titanium dioxide preferably has a spherical shape, a polyhedral shape or an ellipsoidal shape from the viewpoint of less causing image defects such as a black spot. The titanium dioxide further preferably has a spherical shape or a polyhedral shape close to a spherical shape. The titanium dioxide can include anatase type or rutile type titanium oxide.

The particle in the present invention has an oxygen-deficient portion represented by X—Y and a nitrogen-doped portion represented by Y. X and Y are needed to satisfy a relationship of $0.00<Y<X\leq 0.60$. Furthermore, Y can be 0.05 or more. Moreover, X can be 0.30 or less. Moreover, X—Y can be 0.03 or more.

The particle in the present invention can have a peak at a Bragg angle $2\theta\pm0.1°$ of 43.1 to 43.2° in CuKα characteristic X-ray diffraction. The occurrence of the peak is due to a cubic crystal structure including TiO and TiN.

The average primary particle size ($D_1$) of the particle in the present invention can be 50 nm or more and 350 nm or less. When the average primary particle size of the particle in the present invention is 50 nm or more, the particle in the present invention hardly re-aggregates after preparation of a coating liquid for an electroconductive layer. If the particle in the present invention re-aggregates, deterioration in stability of a coating liquid for an electroconductive layer and/or the occurrence of cracking on the surface of an electroconductive layer to be formed can be caused. When the average primary particle size of the particle in the present invention is 350 nm or less, the surface of the electroconductive layer is hardly roughened. If the surface of the electroconductive layer is roughened, local charge injection to the photosensitive layer easily occurs and a black point (black spot) on the white background of an output image is easily noticeable.

In the present invention, the average primary particle size $D_1$ [m] of the particle is determined by using a scanning-type electron microscope as follows. A scanning-type electron microscope (trade name: S-4800) manufactured by Hitachi Ltd. is used to observe a particle to be measured, the respective particle sizes of 100 of the particles in an image obtained by such observation are measured, and the arithmetic average thereof is calculated and defined as the average primary particle size $D_1$ [μm]. The respective particle sizes are obtained as (a+b)/2 where the longest side and the shortest side of a primary particle are defined as a and b, respectively.

The powder resistivity of the particle in the present invention can be $2.0\times10^1$ Ω·cm or more. When the powder resistivity of the particle in the present invention is within the range, leakage resistance can be achieved. Herein, the powder resistivity of the particle in the present invention is measured under a normal temperature and normal humidity (23° C./50% RH) environment. In the present invention, a resistivity meter (trade name: Loresta GP) manufactured by Mitsubishi Chemical Corporation is used as the measurement apparatus. The particle in the present invention, to be measured, is settled at a pressure of 500 kg/cm$^2$ and thus formed into a pellet-shaped measurement sample. The applied voltage is set to 100 V.

The surface of the particle in the present invention may also be treated with a silane coupling agent or the like.

The electroconductive layer in the present invention preferably contains 20% by volume or more and 50% by volume or less of the particle in the present invention based on the total volume of the electroconductive layer. If the content of the particle in the present invention in the electroconductive layer is less than 20% by volume based on the total volume of the electroconductive layer, the particle in the present invention is mutually easily far away. As the particle in the present invention is mutually farther away, the volume resistivity of the electroconductive layer is easily higher. Thus, the following tendency is observed: charge flow is easily disrupted during image formation, the residual potential is easily increased, and variations in dark portion potential and light portion potential are easily caused. If the content of the particle in the present invention in the electroconductive layer is more than 50% by volume based on the total volume of the electroconductive layer, the particle in the present invention is mutually easily contacted. A portion of the particle in the present invention, being contacted, corresponds to a portion locally low in the volume resistivity of the electroconductive layer, causing leakage to easily occur on the electrophotographic photosensitive member.

The electroconductive layer in the present invention further preferably contains 30% by volume or more and 45% by volume or less of the particle in the present invention based on the total volume of the electroconductive layer.

The electroconductive layer in the present invention may include other electroconductive particle. Examples of the material of such other electroconductive particle include a metal oxide, a metal and carbon black. Examples of the metal oxide include zinc oxide, aluminum oxide, indium oxide, silicon oxide, zirconium oxide, tin oxide, titanium oxide, magnesium oxide, antimony oxide and bismuth oxide. Examples of the metal include aluminum, nickel, iron, nichrome, copper, zinc and silver. When the metal oxide is used in such other electroconductive particle, the surface of the metal oxide may be treated with a silane coupling agent or the like, or the metal oxide may also be doped with an element such as phosphorus or aluminum, or an oxide thereof.

Such other electroconductive particle may have a layered configuration having a core particle and a covering layer with which the particle is covered. Examples of the core particle include titanium oxide, barium sulfate and zinc oxide particles. Examples of the material for use in the covering layer include a metal oxide such as tin oxide.

When the metal oxide is used in such other electroconductive particle, the average particle size thereof is preferably 1 nm or more and 500 nm or less, more preferably 3 nm or more and 400 nm or less.

The binder material can be a binder resin. Examples of the binder resin include a polyester resin, a polycarbonate resin, a polyvinyl acetal resin, an acrylic resin, a silicone resin, an epoxy resin, a melamine resin, a polyurethane resin, a phenol resin and an alkyd resin. The binder material in the present invention can be a thermosetting phenol resin or a thermosetting polyurethane resin. When a curable resin is used in the binder material of the electroconductive layer, the binder material to be contained in the coating liquid for an electroconductive layer is a monomer and/or an oligomer of the curable resin.

The electroconductive layer may also further contain a silicone oil, a resin particle and the like.

The average thickness of the electroconductive layer is preferably 0.5 μm or more and 50 μm or less, more preferably 1 μm or more and 40 μm or less, particularly preferably 5 μm or more and 35 μm or less.

The electroconductive layer can be formed by preparing a coating liquid for an electroconductive layer, the coating liquid containing the above respective materials and solvent, forming a coating film of the coating liquid and drying the coating film. Examples of the solvent for use in the coating liquid include an alcohol-based solvent, a sulfoxide-based solvent, a ketone-based solvent, an ether-based solvent, an ester-based solvent and an aromatic hydrocarbon-based solvent. Examples of the method for dispersing the electroconductive particle in the coating liquid for an electroconductive layer include respective dispersion methods using a paint shaker, a sand mill, a ball mill and a liquid collision type high-speed dispersing machine.

The volume resistivity of the electroconductive layer is preferably $1.0\times10^{5}$ Ω·cm or more and $5.0\times10^{12}$ acm or less. When the volume resistivity of the electroconductive layer is $5.0\times10^{12}$ Ω·m or less, charge flow is hardly disrupted during image formation, the residual potential is hardly increased, and variations in dark portion potential and light portion potential are hardly caused. On the other hand, when the volume resistivity of the electroconductive layer is $1.0\times10^{5}$ Ω·cm or more, the amount of a charge which flows into the electroconductive layer during charging of the electrophotographic photosensitive member is hardly too large, and leakage hardly occurs. The volume resistivity of the electroconductive layer is further preferably $1.0\times10^{3}$ Ω·cm or more and $1.0\times10^{11}$ Ω·cm or less.

Figure 2:
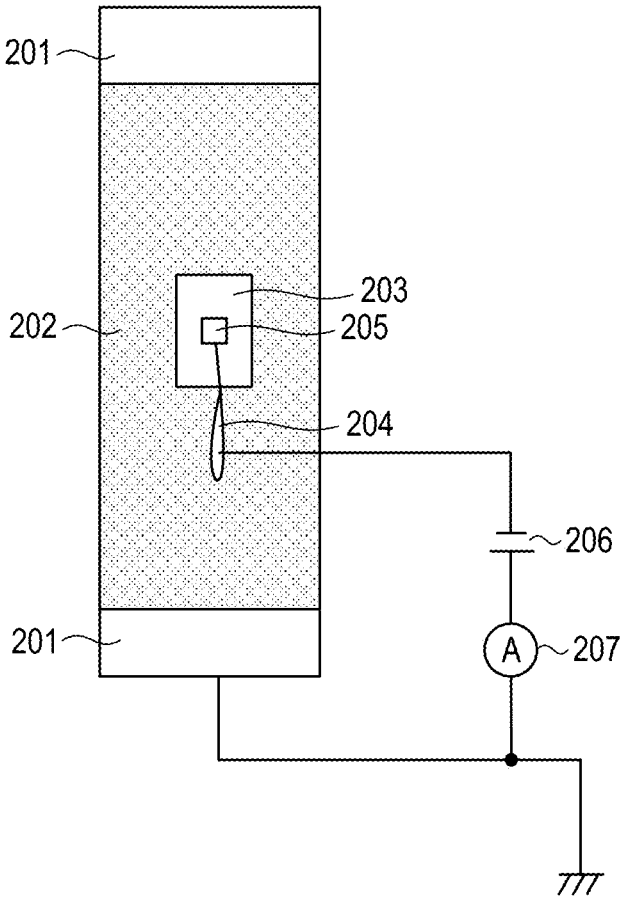
FIG. 2 is a top view for describing a method for measuring the volume resistivity of an electroconductive layer.
Figure 3:
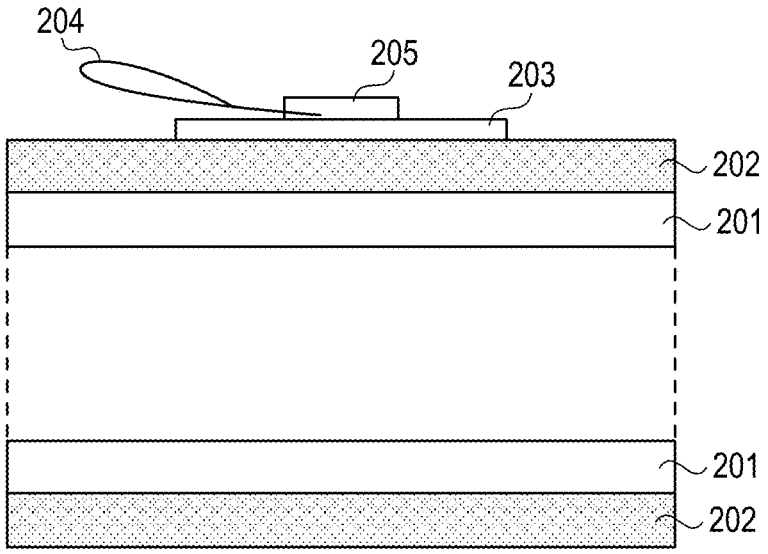
FIG. 3 is a cross sectional view for describing the method for measuring the volume resistivity of an electroconductive layer.

The method for measuring the volume resistivity of the electroconductive layer of the electrophotographic photosensitive member is described with reference to FIG. 2 and FIG. 3. FIG. 2 is a top view for describing the method for measuring the volume resistivity of the electroconductive layer, and FIG. 3 is a cross sectional view for describing the method for measuring the volume resistivity of the electroconductive layer.

The volume resistivity of the electroconductive layer is measured under a normal temperature and normal humidity (23° C./50% RH) environment. A copper tape 203 (Model No. 1181 produced by Sumitomo 3M Limited) is pasted onto the surface of an electroconductive layer 202, and used as an electrode closer to the front surface of the electroconductive layer 202. In addition, a support 201 is used as an electrode closer to the rear surface of the electroconductive layer 202. A power source 206 that applies a voltage between the copper tape 203 and the support 201, and current measurement equipment 207 that measures a current flowing between the copper tape 203 and the support 201 are each disposed. In order to apply a voltage to the copper tape 203, a copper wire 204 is placed on the copper tape 203, a copper tape 205 for securement of a copper wire, similar to the copper tape 203, is pasted over the copper wire 204 so that the copper wire 204 is not spread out of the copper tape 203, and the copper wire 204 is secured to the copper tape 203. A voltage is applied to the copper tape 203 by use of the copper wire 204. When the background current value in no application of any current between the copper tape 203 and the support 201 is designated as $I_0$ [A], the current value in application of a voltage of −1 V only as a DC voltage (DC component) is designated as I [A], the thickness of the electroconductive layer 202 is designated as d [cm] and the area of the electrode (copper tape 203) closer to the front surface of the electroconductive layer 202 is designated as S [$cm^2$], the value represented by the following expression (I) is defined as the volume resistivity ρ [Ω·cm] of the electroconductive layer 202.

$$\rho=1/(I-I_0)\times S/d\ [\Omega\cdot\mathrm{cm}] \qquad (I)$$

A trace amount of current of $1\times10^{-6}$A or less, as an absolute value, is measured in the measurement, and therefore the measurement can be performed by use of equipment that can measure a trace amount of current as the current measurement equipment 207. Examples of such equipment include a pA meter (trade name: 4140B) manufactured by Hewlett-Packard Japan, Ltd. Herein, the volume resistivity of the electroconductive layer is represented as the same value even when measured in the state where only the electroconductive layer is formed on the support, and even when measured in the state where only the electroconductive layer remains on the support by peeling off of respective layers (photosensitive layer and the like) on the electroconductive layer from the electrophotographic photosensitive member.

<Undercoat Layer>

In the present invention, an undercoat layer may also be provided on the electroconductive layer. The undercoat layer can be provided to thereby increase an adhesion function between layers and impart a function of inhibiting charge injection.

The undercoat layer can contain a resin. The undercoat layer may also be formed as a cured film by polymerization of a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinylphenol resin, an alkyd resin, a polyvinyl alcohol resin, a polyethylene oxide resin, a polypropylene oxide resin, a polyamide resin, a polyamide acid resin, a polyimide resin, a polyamideimide resin and a cellulose resin.

With respect to the monomer having a polymerizable functional group, examples of the polymerizable functional group include an isocyanate group, a block isocyanate group, a methylol group, an alkylated methylol group, an epoxy group, a metal alkoxide group, a hydroxyl group, an amino group, a carboxyl group, a thiol group, a carboxylic anhydride group and a carbon-carbon double bond group.

The undercoat layer may also further contain an electron transport material, a metal oxide, a metal, an electroconductive polymer and the like in order to enhance electrical characteristics. In particular, an electron transport material or a metal oxide can be used.

Examples of the electron transport material include a quinone compound, an imide compound, a benzoimidazole compound, a cyclopentadienylidene compound, a fluorenone compound, a xanthone compound, a benzophenone compound, a cyanovinyl compound, a halogenated aryl compound, a silole compound and a boron-containing compound. The undercoat layer may also be formed as a cured film obtained by using, as the electron transport material, an electron transport material having a polymerizable functional group, and copolymerizing the electron transport material with the monomer having a polymerizable functional group.

Examples of the metal oxide include indium tin oxide, tin oxide, indium oxide, titanium oxide, zinc oxide, aluminum oxide and silicon dioxide. Examples of the metal include gold, silver and aluminum.

The undercoat layer may also further contain an additive.

The average thickness of the undercoat layer is preferably 0.1 μm or more and 50 μm or less, more preferably 0.2 μm or more and 40 μm or less, particularly preferably 0.3 μm or more and 30 μm or less.

The undercoat layer can be formed by preparing a coating liquid for an undercoat layer, the coating liquid containing the above respective materials and solvent, and drying and/or curing a coating film of the coating liquid. Examples of the solvent for use in the coating liquid include an alcohol-based solvent, a ketone-based solvent, an ether-based solvent, an ester-based solvent and an aromatic hydrocarbon-based solvent.

<Photosensitive Layer>

The photosensitive layer of the electrophotographic photosensitive member is mainly classified to a layered type photosensitive layer (1) and a monolayer type photosensitive layer (2). The layered type photosensitive layer (1) includes a charge generation layer containing a charge generation material and a charge transport layer containing a charge transport material. The monolayer type photosensitive layer (2) includes a photosensitive layer containing both of a charge generation material and a charge transport material.

Layered Type Photosensitive Layer (1)

The layered type photosensitive layer includes a charge generation layer and a charge transport layer.

Charge Generation Layer (1-1)

The charge generation layer can contain a charge generation material and a resin.

Examples of the charge generation material include an azo pigment, a perylene pigment, a polycyclic quinone pigment, an indigo pigment and a phthalocyanine pigment. In particular, an azo pigment or a phthalocyanine pigment can be adopted. As the phthalocyanine pigment, an oxytitanium phthalocyanine pigment, a chlorogallium phthalocyanine pigment or a hydroxygallium phthalocyanine pigment can be adopted.

The content of the charge generation material in the charge generation layer is preferably 40% by mass or more and 85% by mass or less, more preferably 60% by mass or more and 80% by mass or less based on the total mass of the charge generation layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin and a polyvinyl chloride resin. In particular, a polyvinyl butyral resin is more preferable.

The charge generation layer may also further contain additives such as an antioxidant and an ultraviolet absorber. Specific examples include a hindered phenol compound, a hindered amine compound, a sulfur compound, a phosphorus compound and a benzophenone compound.

The average thickness of the charge generation layer is preferably 0.1 μm or more and 1 μm or less, more preferably 0.15 μm or more and 0.4 μm or less.

The charge generation layer can be formed by preparing a coating liquid for a charge generation layer, the coating liquid containing the above respective materials and solvent, and forming a coating film of the coating liquid and drying the coating film. Examples of the solvent for use in the coating liquid include an alcohol-based solvent, a sulfoxide-based solvent, a ketone-based solvent, an ether- based solvent, an ester-based solvent and an aromatic hydrocarbon-based solvent.

Charge Transport Layer (1-2)

The charge transport layer can contain a charge transport material and a resin.

Examples of the charge transport material include a polycyclic aromatic compound, a heterocyclic compound, a hydrazone compound, a styryl compound, an enamine compound, a benzidine compound, a triarylamine compound and a resin having a group derived from such a material. In particular, a triarylamine compound or a benzidine compound can be adopted.

The content of the charge transport material in the charge transport layer is preferably 25% by mass or more and 70% by mass or less, more preferably 30% by mass or more and 55% by mass or less based on the total mass of the charge transport layer.

Examples of the resin include a polyester resin, a polycarbonate resin, an acrylic resin and a polystyrene resin. In particular, a polycarbonate resin or a polyester resin can be adopted. As the polyester resin, a polyarylate resin can be particularly adopted.

The content ratio (mass ratio) of the charge transport material and the resin is preferably 4:10 to 20:10, more preferably 5:10 to 12:10.

The charge transport layer may also contain additives such as an antioxidant, an ultraviolet absorber, a plasticizer, a leveling agent, a slipperiness imparter and a wear resistance improver. Specific examples include a hindered phenol compound, a hindered amine compound, a sulfur compound, a phosphorus compound, a benzophenone compound, a siloxane-modified resin, silicone oil, a fluororesin particle, a polystyrene resin particle, a polyethylene resin particle, a silica particle, an alumina particle and a boron nitride particle.

The average thickness of the charge transport layer is preferably 5 μm or more and 50 μm or less, more preferably 8 μm or more and 40 μm or less, particularly preferably 9 μm or more and 30 μm or less.

The charge transport layer can be formed by preparing a coating liquid for a charge transport layer, the coating liquid containing the above respective materials and solvent, and forming a coating film of the coating liquid and drying the coating film. Examples of the solvent for use in the coating liquid include an alcohol-based solvent, a ketone-based solvent, an ether-based solvent, an ester-based solvent and an aromatic hydrocarbon-based solvent. As such a solvent, an ether-based solvent or an aromatic hydrocarbon-based solvent can be adopted.

Monolayer Type Photosensitive Layer (2)

The monolayer type photosensitive layer can be formed by preparing a coating liquid for a photosensitive layer, the coating liquid containing a charge generation material, a charge transport material, a resin and a solvent, forming a coating film of the coating liquid and drying the coating film. Examples of the charge generation material, the charge transport material and the resin are the same as the materials exemplified in the "layered type photosensitive layer (1)".

<Protection Layer>

In the present invention, a protection layer may also be provided on the photosensitive layer. The protection layer can be provided to thereby enhance durability.

The protection layer can contain an electroconductive particle and/or a charge transport material, and a resin. Examples of the electroconductive particle include particles of metal oxides such as titanium oxide, zinc oxide, tin oxide and indium oxide.

Examples of the charge transport material include a polycyclic aromatic compound, a heterocyclic compound, a hydrazone compound, a styryl compound, an enamine compound, a benzidine compound, a triarylamine compound and a resin having a group derived from such a material. In particular, a triarylamine compound or a benzidine compound can be adopted.

Examples of the resin include a polyester resin, an acrylic resin, a phenoxy resin, a polycarbonate resin, a polystyrene resin, a phenol resin, a melamine resin and an epoxy resin. In particular, a polycarbonate resin, a polyester resin or an acrylic resin can be adopted.

The protection layer may also be formed as a cured film by polymerization of a composition containing a monomer having a polymerizable functional group. Examples of the reaction here include a thermal polymerization reaction, a photopolymerization reaction and a radiation polymerization reaction. With respect to the monomer having a polymerizable functional group, examples of the polymerizable functional group include an acrylic group and a methacrylic group. A material having charge transport ability may also be used as the monomer having a polymerizable functional group.

The protection layer may also contain additives such as an antioxidant, an ultraviolet absorber, a plasticizer, a leveling agent, a slipperiness imparter and a wear resistance improver. Specific examples include a hindered phenol compound, a hindered amine compound, a sulfur compound, a phosphorus compound, a benzophenone compound, a siloxane-modified resin, silicone oil, a fluororesin particle, a polystyrene resin particle, a polyethylene resin particle, a silica particle, an alumina particle and a boron nitride particle.

The average thickness of the protection layer is preferably 0.5 μm or more and 10 μm or less, preferably 1 μm or more and 7 μm or less.

The protection layer can be formed by preparing a coating liquid for a protection layer, the coating liquid containing the above respective materials and solvent, forming a coating film of the coating liquid, and drying and/or curing the coating film. Examples of the solvent for use in the coating liquid include an alcohol-based solvent, a ketone-based solvent, an ether-based solvent, a sulfoxide-based solvent, an ester-based solvent and an aromatic hydrocarbon-based solvent.

[Process Cartridge and Electrophotographic Apparatus]

The process cartridge of the present invention integrally supports the above-mentioned electrophotographic photosensitive member, and at least one unit selected from a charging unit, a developing unit, a transfer unit and a cleaning unit, and is detachably mountable on a main body of an electrophotographic apparatus.

The electrophotographic apparatus of the present invention includes the above-mentioned electrophotographic photosensitive member, a charging unit, an exposure unit, a developing unit and a transfer unit.

FIG. 1 illustrates one example of a schematic configuration of an electrophotographic apparatus including a process cartridge including an electrophotographic photosensitive member.

Reference numeral 1 represents a cylindrical electrophotographic photosensitive member, and is rotatably driven at a predetermined circumferential velocity in an arrow direction around an axis 2. The surface of the electrophotographic photosensitive member 1 is charged at a predetermined positive or negative potential by a charging unit 3. While a roller charging system by a roller type charging member is illustrated in FIG. 1, any charging system such as a corona charging system, a close charging system or an injection charging system may also be adopted. The surface of the electrophotographic photosensitive member 1 charged is irradiated with exposure light 4 from an exposure unit (not illustrated), and an electrostatic latent image corresponding to objective image information is formed. The electrostatic latent image formed on the surface of the electrophotographic photosensitive member 1 is developed by a toner accommodated in a developing unit 5, and a toner image is formed on the surface of the electrophotographic photosensitive member 1. The toner image formed on the surface of the electrophotographic photosensitive member 1 is transferred to a transfer material 7 by a transfer unit 6. The transfer material 7 to which the toner image is transferred is conveyed to a fixing unit 8, subjected to a fixing treatment of the toner image and discharged to the outside of the electrophotographic apparatus. The electrophotographic apparatus may include a cleaning unit 9 for removal of any attached material such as a toner remaining on the surface of the electrophotographic photosensitive member 1 after transferring. A so-called cleanerless system that removes the attached material by a developing unit or the like with no cleaning unit being separately provided may also be used. The electrophotographic apparatus may include a neutralization mechanism that performs a neutralization treatment of the surface of the electrophotographic photosensitive member 1 with pre-exposure light 10 from a pre-exposure unit (not illustrated). A guiding unit 12 such as a rail may also be provided in order to detachably mount a process cartridge 11 of the present invention on the main body of the electrophotographic apparatus.

The electrophotographic photosensitive member of the present invention can be used for a laser beam printer, an LED printer, a copier, a facsimile and a combined machine.

EXAMPLES

Hereinafter, the present invention will be described in more detail with reference to Examples and Comparative Examples. The present invention is not limited to the following Examples at all without departing from the gist thereof. Herein, the term "parts" in the following description of Examples means parts by mass unless otherwise particularly noted.

[Production Example of Particle]

(Production Example of Particle 1)

Rutile type titanium dioxide ($TiO_2$) having an average primary particle size of 140 nm was subjected to a reduction treatment at 600° C. under an ammonia gas stream at a linear flow rate of 3 cm/sec for 6 hours. Subsequently, an aqueous 10% hydrochloric acid solution was added to the resulting powder, and stirred and left to stand. The resulting supernatant was removed, and decantation by pure water was performed twice to thereby dry the filtered product separated by filtration. The resulting filtered product was subjected to a grinding treatment to provide a powder of particle 1 having an average primary particle size of 140 nm.

The element ratio of the resulting particle was analyzed by the following ESCA analysis. The measurement conditions are as described below.

<ESCA Analysis>

Apparatus used: VersaProbe II manufactured by Ulvac-Phi Inc.

X-ray Source: Al Ka: 1486.6 eV (25 W 15 kV)

Measurement Area: φ 100 μm

Spectral Region: 300×200 μm, angle: 45°

Pass Energy: 58.70 eV

Step Size: 0.125 eV

The surface atomic concentration (atoms %) is calculated from the respective peak intensities of elements measured in the above conditions by use of relative sensitivity factors provided by Ulvac-Phi Inc. The respective peak top ranges measured of the elements adopted are as follows.

O: Photoelectron energy derived from electron orbital 1*s*: 525 to 545 eV

N: Photoelectron energy derived from electron orbital 1*s*: 390 to 410 eV

Ti: Photoelectron energy derived from electron orbital 2*p*: 450 to 470 eV

Herein, in order to remove the influence of surface contamination, Ar ion sputtering was performed at an intensity of 0.5 to 4.0 kV, and thereafter measurement was performed.

Figure 4:
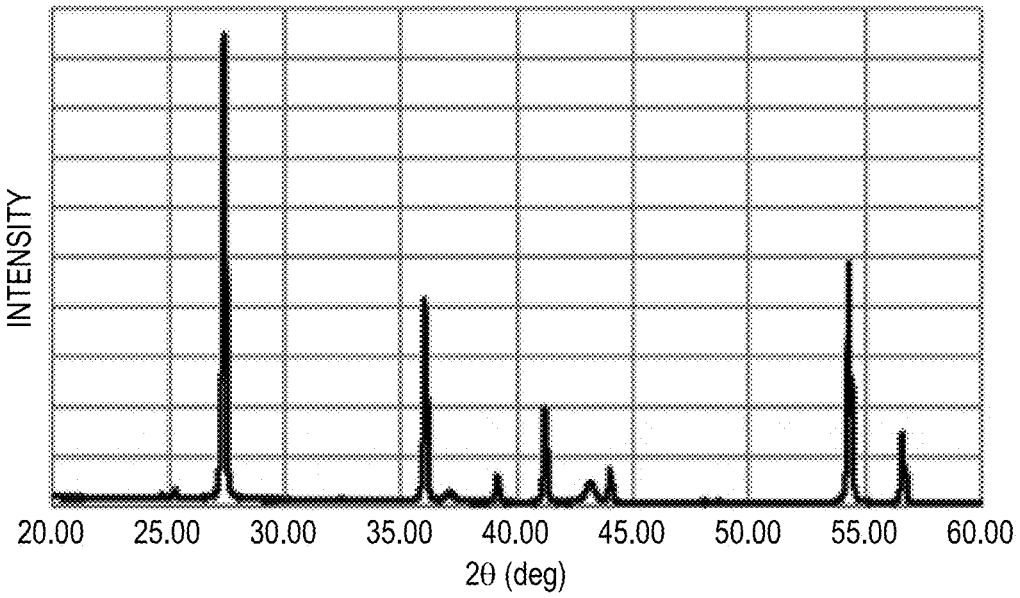
FIG. 4 is a powder X-ray diffraction pattern of a particle obtained in Examples.
Figure 5:
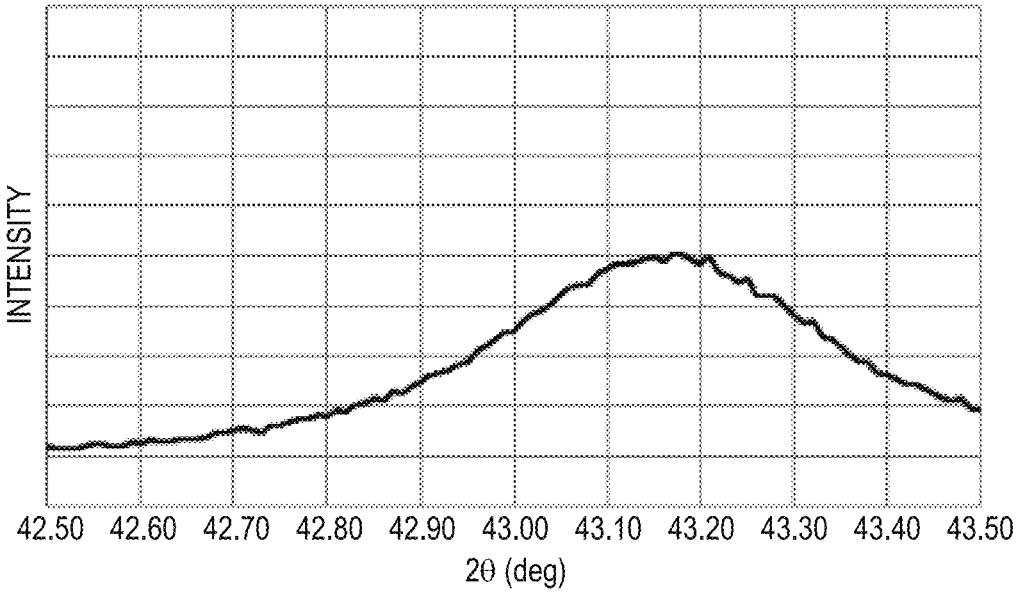
FIG. 5 illustrates an enlarged portion of the powder X-ray diffraction pattern of a particle obtained in Examples.

The powder X-ray diffraction pattern of the resulting particle is illustrated in FIGS. 4 and 5. Herein, powder X-ray diffraction measurement was performed in the following conditions.

<Powder X-Ray Diffraction Measurement>

Measurement machine used: X-ray diffractometer: Smart Lab manufactured by Rigaku Corporation X-ray bulb: Cu Tube voltage: 45 KV Tube current: 200 mA Optical system: CBO Scanning method: 2θ/θ scanning Mode: continuous Range specification: absolute Counting time: 10

Sampling interval: 0.01°

Start angle (2θ) : 5.0°

Stop angle (2θ) : 60.0°

IS: 1/2

RS1: 20 mm

RS2: 20 mm

Attenuator: Open

Attachment: standard Z stage (Production Examples of Particles 2 to 13)

Each of particles 2 to 13 was obtained as shown in Table 1 in the same manner as in particle 1 except that the average primary particle size and the conditions in the reduction treatment of the base powder used in production of particle 1 were changed.

The powder resistivity of each of particles 1 to 13 obtained is shown in Table 1.

TABLE 1

| Particle | Crystal form of base powder | X | Y | Presence or absence of X-ray diffraction peak | Average primary particle size nm | Powder resistivity Ω cm |
|---|---|---|---|---|---|---|
| 1 | Rutile | 0.30 | 0.24 | Presence | 140 | $9.5 \times 10^3$ |
| 2 | Rutile | 0.46 | 0.35 | Presence | 140 | $2.2 \times 10^1$ |
| 3 | Rutile | 0.55 | 0.43 | Presence | 140 | $2.7 \times 10^0$ |
| 4 | Rutile | 0.60 | 0.49 | Presence | 140 | $1.4 \times 10^0$ |
| 5 | Rutile | 0.05 | 0.02 | Presence | 140 | $2.3 \times 10^8$ |
| 6 | Rutile | 0.03 | 0.02 | Presence | 140 | $5.5 \times 10^8$ |
| 7 | Rutile | 0.23 | 0.18 | Presence | 50 | $2.3 \times 10^5$ |
| 8 | Rutile | 0.21 | 0.16 | Presence | 350 | $2.5 \times 10^2$ |
| 9 | Rutile | 0.25 | 0.17 | Presence | 30 | $8.8 \times 10^4$ |
| 10 | Rutile | 0.22 | 0.15 | Presence | 370 | $2.9 \times 10^5$ |
| 11 | Rutile | 0.58 | 0.56 | Absence | 140 | $2.0 \times 10^0$ |
| 12 | Anatase | 0.20 | 0.17 | Presence | 100 | $5.2 \times 10^5$ |
| 13 | Rutile | 0.24 | 0.19 | Presence | 140 | $9.9 \times 10^4$ |

[Preparation Example of Coating Liquid for Electroconductive Layer]

(Preparation Example of Coating Liquid 1 for Electroconductive Layer)

A butyral resin (15 parts) (trade name: BM-1, produced by Sekisui Chemical Co., Ltd.) as a polyol resin and 15 parts of a blocked isocyanate resin (trade name: TPA-B80E, 80% solution, produced by Asahi Kasei Corporation) were dissolved in a mixed solvent of 45 parts of methyl ethyl ketone/85 parts of 1-butanol, thereby providing a solution. Particle 1 (60 parts) was added to the solution, and the resultant was used as a dispersion medium and placed in a vertical sand mill using 120 parts of glass beads having an average particle size of 1.0 mm, and subjected to a dispersion treatment under an atmosphere of 23±3° C. in a condition of a number of rotations of 1500 rpm (circumferential velocity: 5.5 m/s) for 4 hours, thereby providing a dispersion liquid. The glass beads were removed from the dispersion liquid by a mesh. Silicone oil (0.01 parts) (trade name: SH28 PAINT ADDITIVE, produced by Dow Corning Toray Co., Ltd.) as a leveling agent and 5 parts of a crosslinking type polymethyl methacrylate (PMMA) particle (trade name: Techpolymer SSX-102, produced by Sekisui Plastics Co., Ltd., average primary particle size: 2.5 μm) as a surface roughening material were added to the dispersion liquid from which the glass beads were removed, and stirred, thereby preparing coating liquid 1 for an electroconductive layer.

(Preparation Examples of Coating Liquids 2 to 15 and C1 to C5 for Electroconductive Layer)

Each of coating liquids 2 to 15 and C1 to C5 for an electroconductive layer was prepared by the same operation as in Preparation Example of coating liquid 1 for an electroconductive layer except that the type and the amount (number of parts) of the particle for use in preparation of the coating liquid for an electroconductive layer were changed as shown in Table 2. Herein, the details of the particle for use in preparation of each of C1 to C5 are as described below.

C1: titanium oxide (item number: JR405) produced by Tayca Corporation

C2, C3: Black Titanium Oxide (item number: 13M, 12S) produced by Mitsubishi Materials Corporation C4: black titanium oxide (item number: M1) produced by Ishihara Sangyo Kaisha, Ltd.

C5: nitrogen-doped titanium oxide

Figure 6:
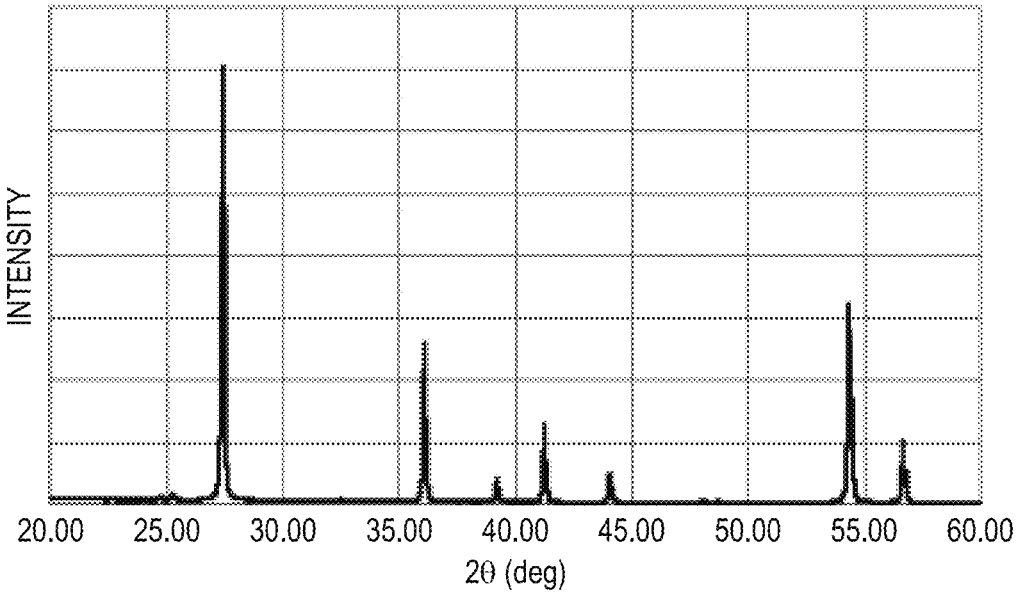
FIG. 6 is a powder X-ray diffraction pattern of a particle obtained in Comparative Examples.
Figure 7:
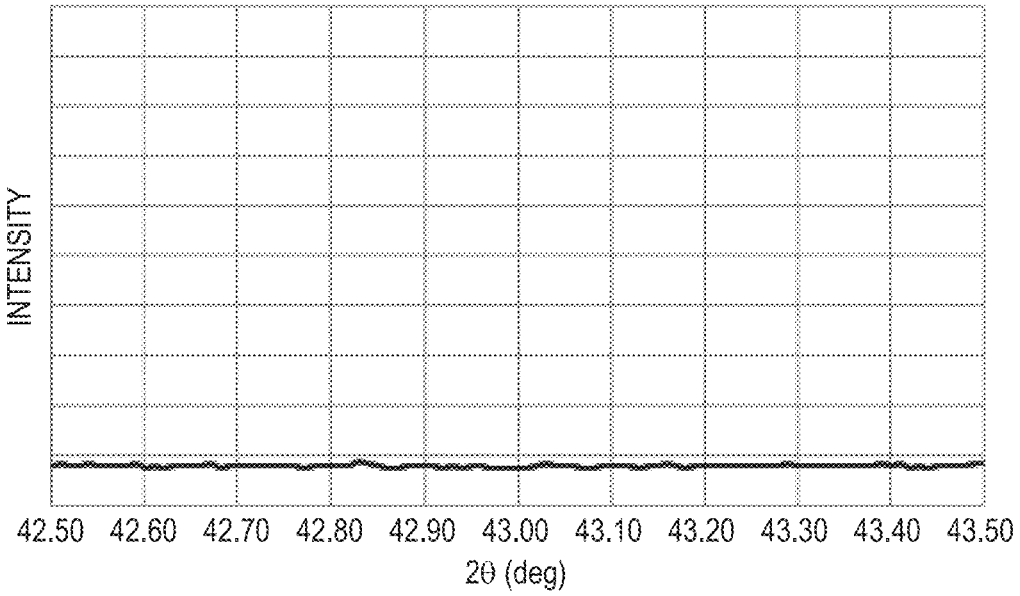
FIG. 7 illustrates an enlarged portion of the powder X-ray diffraction pattern of a particle obtained in Comparative Examples.

The powder X-ray diffraction pattern of C1 is illustrated in FIGS. 6 and 7.

TABLE 2

| Coating liquid for electroconductive layer | Particle | Particle (parts) |
|---|---|---|
| 1 | Particle 1 | 75 |
| 2 | Particle 2 | 75 |
| 3 | Particle 3 | 112 |
| 4 | Particle 4 | 112 |
| 5 | Particle 5 | 75 |
| 6 | Particle 5 | 28 |
| 7 | Particle 5 | 168 |
| 8 | Particle 5 | 20 |
| 9 | Particle 6 | 75 |
| 10 | Particle 7 | 75 |
| 11 | Particle 8 | 75 |
| 12 | Particle 9 | 75 |
| 13 | Particle 10 | 75 |
| 14 | Particle 11 | 75 |
| 15 | Particle 12 | 70 |
| C1 | Titanium oxide JR405 | 75 |
| C2 | Titanium Black 13M | 75 |
| C3 | Titanium Black 12S | 75 |
| C4 | Black titanium oxide M1 | 75 |
| C5 | Nitrogen-doped titanium oxide | 75 |

(Preparation Example of Coating Liquid 16 for Electroconductive Layer)

A phenol resin (80 parts) (monomer/oligomer of phenol resin) (trade name: Plyophen J-325, produced by DIC Corporation, resin content: 60%) as a binder material was dissolved in 80 parts of 1-methoxy-2-propanol as a solvent, providing a solution.

Particle 1 (136 parts) was added to the solution, and the resultant was used as a dispersion medium and placed in a vertical sand mill using 200 parts of glass beads having an average particle size of 1.0 mm, and subjected to a dispersion treatment in conditions of a dispersion liquid temperature of 23±3° C. and a number of rotations of 1000 rpm (circumferential velocity: 3.7 m/s) for 4 hours, thereby providing a dispersion liquid. The glass beads were removed from the dispersion liquid by a mesh. Silicone oil (0.015 parts) (trade name: SH28 PAINT ADDITIVE, produced by Dow Corning Toray Co., Ltd.) as a leveling agent and 15 parts of a silicone resin particle (trade name: Tospearl 120, produced by Momentive Performance Materials Inc., average particle size: 2 μm) as a surface roughening material were added to the dispersion liquid from which the glass beads were removed, and stirred, and the resultant was subjected to filtration under pressure by use of PTFE filter paper (trade name: PF060, produced by Toyo Roshi Kaisha, Ltd.), thereby preparing coating liquid 16 for an electroconductive layer.

(Preparation Examples of Coating Liquids 17 to 38 for Electroconductive Layer)

Each of coating liquids 17 to 30 for an electroconductive layer was prepared by the same operation as in Preparation Example of coating liquid 1 for an electroconductive layer except that the type and the amount (number of parts) of the particle for use in preparation of the coating liquid for an electroconductive layer were changed as shown in Table 3.

TABLE 3

| Coating liquid for electroconductive layer | Particle | Particle (parts) |
|---|---|---|
| 16 | Particle 1 | 136 |
| 17 | Particle 2 | 136 |
| 18 | Particle 3 | 204 |

TABLE 3-continued

| Coating liquid for electroconductive layer | Particle | Particle (parts) |
|---|---|---|
| 19 | Particle 4 | 204 |
| 20 | Particle 5 | 136 |
| 21 | Particle 5 | 51 |
| 22 | Particle 5 | 305 |
| 23 | Particle 5 | 36 |
| 24 | Particle 6 | 136 |
| 25 | Particle 7 | 136 |
| 26 | Particle 8 | 136 |
| 27 | Particle 9 | 136 |
| 28 | Particle 10 | 136 |
| 29 | Particle 11 | 136 |
| 30 | Particle 12 | 128 |

(Production Example of Particle S1)

A water-containing titanium oxide slurry obtained by hydrolysis of an aqueous titanyl sulfate solution was washed with an aqueous alkaline solution.

Next, hydrochloric acid was added to the water-containing titanium oxide slurry, and the pH was adjusted to 0.7, providing a titania sol dispersion liquid.

An aqueous strontium chloride solution was added in an amount of 1.1-fold by mol relative to 2.0 mol of the titania sol dispersion liquid (in terms of titanium oxide), placed in a reaction vessel and purged with a nitrogen gas. Furthermore, pure water was added so that the titanium oxide concentration was 1.0 mol/L.

Next, the resultant was stirred and mixed, and warmed to 85° C., and thereafter 800 mL of an aqueous 5 N sodium hydroxide solution was added thereto over 20 minutes with ultrasonic vibration and thereafter subjected to a reaction for 20 minutes. After pure water at 5° C. was added to the slurry subjected to the reaction and quenching was made until the temperature reached 30° C. or less, the supernatant liquid was removed. Furthermore, an aqueous hydrochloric acid solution having a pH of 5.0 was added to the slurry and stirred for 1 hour, and thereafter repeatedly washed with pure water. Furthermore, the resultant was subjected to neutralization with sodium hydroxide, filtered by a Nutsche funnel and washed with pure water. The resulting cake was dried to provide particle S.

Particle S produced above was subjected to X-ray diffraction measurement, and it was found that the maximum peak at a position of $2\theta=32.20\pm0.20$ ($\theta$: Bragg angle) in the CuK$\alpha$ X-ray diffraction spectrum was observed and the half-value width of the maximum peak was 0.28 deg. The average primary particle size of particle S was 50 nm.

Next, 100 parts of particle S produced and 500 parts of toluene were stirred and mixed, and 2 parts of N-2-(aminoethyl)-3-aminopropylmethyldimethoxysilane (trade name: KBM602, produced by Shin-Etsu Chemical Co., Ltd.) as a silane coupling agent was added thereto and stirred for 6 hours. Thereafter, toluene was distilled off under reduced pressure, and heated and dried at 130° C. for 6 hours, providing particle S1 surface-treated.

(Preparation Example of Coating Liquid X1 for Electroconductive Layer)

A butyral resin (15 parts) (trade name: BM-1, produced by Sekisui Chemical Co., Ltd.) as a polyol resin and 15 parts of a blocked isocyanate resin (trade name: TPA-B80E, 80% solution, produced by Asahi Kasei Corporation) were dissolved in a mixed solvent of 45 parts of methyl ethyl ketone/85 parts of 1-butanol, thereby providing a solution.

Particle 1 (75 parts) and 32 parts of particle S1 were added to the solution, and the resultant was used as a dispersion medium and placed in a vertical sand mill using 120 parts of glass beads having an average particle size of 1.0 mm, and subjected to a dispersion treatment under an atmosphere of 23±3° C. in a condition of a number of rotations of 1500 rpm (circumferential velocity: 5.5 m/s) for 4 hours, thereby providing a dispersion liquid. The glass beads were removed from the dispersion liquid by a mesh. Silicone oil (0.01 parts) (trade name: SH28 PAINT ADDITIVE, produced by Dow Corning Toray Co., Ltd.) as a leveling agent and 5 parts of a crosslinking type polymethyl methacrylate (PMMA) particle (trade name: Techpolymer SSX-102, produced by Sekisui Plastics Co., Ltd., average primary particle size: 2.5 μm) as a surface roughening material were added to the dispersion liquid from which the glass beads were removed, and stirred, and the resultant was subjected to filtration under pressure by use of PTFE filter paper (trade name: PF060, produced by Toyo Roshi Kaisha, Ltd.), thereby preparing coating liquid X1 for an electroconductive layer.

(Preparation Example of Coating Liquid X2 for Electroconductive Layer)

Coating liquid X2 for an electroconductive layer was prepared in the same manner as in coating liquid X1 for an electroconductive layer except that the mixed solvent of 45 parts of methyl ethyl ketone/85 parts of 1-butanol in preparation of coating liquid X1 for an electroconductive layer was changed to a mixed solvent of 36 parts of methyl ethyl ketone/68 parts of 1-butanol and furthermore the amount of particle S1 used was changed from 32 parts to 4 parts.

<Production Example of Electrophotographic Photosensitive Member>

(Production Example of Electrophotographic Photosensitive Member 1)

An aluminum cylinder (JIS-A3003, aluminum alloy) produced by a production method including extrusion and drawing, having a length of 257 mm and a diameter of 24 mm, was used as a support.

The support was dip coated with coating liquid 1 for an electroconductive layer under a normal temperature and normal humidity (23° C./50% RH) environment, and the resulting coating film was dried and thermally cured at 170° C. for 30 minutes, thereby forming an electroconductive layer having a thickness of 20 μm. The volume resistivity of the electroconductive layer was measured by the above method and was found to be $2\times10^8$ acm. The thickness and the volume resistivity of the resulting electroconductive layer are shown in Table 3.

Next, 4.5 parts of N-methoxymethylated nylon (trade name: Toresin EF-30T, produced by Nagase ChemteX Corporation) and 1.5 parts of a copolymerized nylon resin (trade name: Amilan CM8000, produced by Toray Industries, Inc.) were dissolved in a mixed solvent of 65 parts of methanol/30 parts of n-butanol, thereby preparing a coating liquid for an undercoat layer. The electroconductive layer was dip coated with the coating liquid for an undercoat layer, and the resulting coating film was dried at 70° C. for 6 minutes, thereby forming an undercoat layer having a thickness of 0.85 μm.

Next, 10 parts of a hydroxygallium phthalocyanine crystal (charge generation material) having a crystal form having strong peaks at Bragg angles (2θ±0.2°) of 7.5°, 9.9°, 16.3°, 18.6°, 25.1° and 28.3° in CuKα characteristic X-ray diffraction, 5 parts of polyvinyl butyral (trade name: S-LEC BX-1, produced by Sekisui Chemical Co., Ltd.) and 250 parts of cyclohexanone were placed in a sand mill using glass beads having a diameter of 0.8 mm, and subjected to a dispersion treatment in a condition of a dispersion treatment time of 3 hours, and thereafter 250 parts of ethyl acetate was added thereto, thereby preparing a coating liquid for a charge generation layer. The undercoat layer was dip coated with the coating liquid for a charge generation layer, and the resulting coating film was dried at 100° C. for 10 minutes, thereby forming a charge generation layer having a thickness of 0.15 μm.

Next, 6.0 parts of an amine compound (charge transport material) represented by the following formula (CT-1), (CT-1)

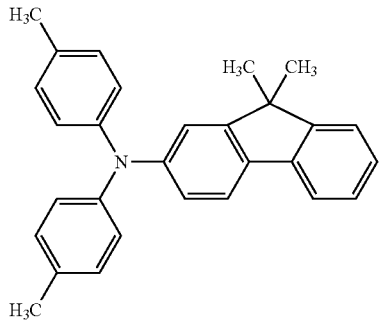

2.0 parts of an amine compound (charge transport material) represented by the following formula (CT-2), (CT-2)

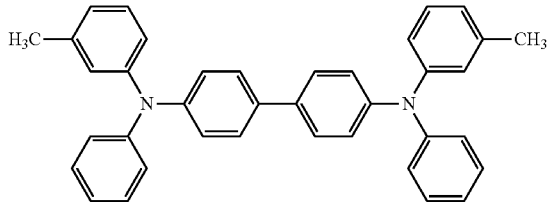

10 parts of bisphenol Z type polycarbonate (trade name: 2400, produced by Mitsubishi Engineering-Plastics Corporation), and 0.36 parts of siloxane-modified polycarbonate ((B-1): (B-2)=95:5 (molar ratio)) having a repeating structural unit represented by the following formula (B-1) and a repeating structural unit represented by the following formula (B-2) and having a terminal structure represented by the following formula (B-3)

(B-1)

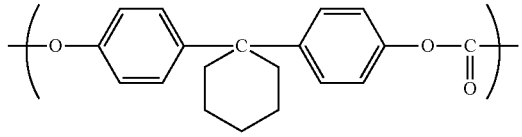

(B-2)

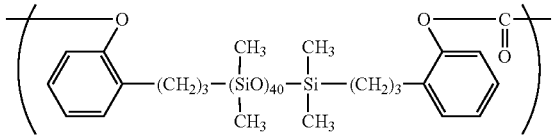

-continued (B-3)

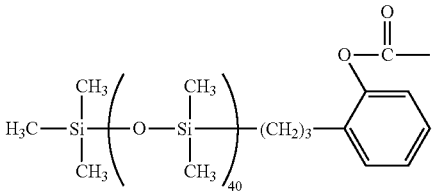

were dissolved in a mixed solvent of 60 parts of o-xylene/40 parts of dimethoxymethane/2.7 parts of methyl benzoate, thereby preparing a coating liquid for a charge transport layer. The charge generation layer was dip coated with the coating liquid for a charge transport layer, and the resulting coating film was dried at 125° C. for 30 minutes, thereby forming a charge transport layer having a thickness of 16.0 μm. As described above, electrophotographic photosensitive member 1 whose surface layer was a charge transport layer was produced.

(Production Examples of Electrophotographic Photosensitive Members 2 to 38, X1 to 2 and C1 to C6)

Each of electrophotographic photosensitive members 2 to 38, X1 to 2 and C1 to C6, whose surface layer was a charge transport layer, was produced by the same operation as in Production Example of electrophotographic photosensitive member 1 except that the coating liquid for an electroconductive layer used in production of the electrophotographic photosensitive member, the thickness of the electroconductive layer and the presence or absence of the undercoat layer were as shown in Table 3. The volume resistivity of the electroconductive layer was measured in the same manner as in electrophotographic photosensitive member 1. The results are shown in Table 3.

Electrophotographic photosensitive members 1 to 38 and X1 to 2 were adopted for Examples of the present invention and electrophotographic photosensitive members C1 to C6 were adopted for Comparative Examples.

<Analysis of Electroconductive Layer of Electrophotographic Photosensitive Member>

Each of electrophotographic photosensitive members 1 to 38, X1 to 2 and C1 to C6 for electroconductive layer analysis was cut to a size of 5 mm square, thereby providing five pieces with respect to each electrophotographic photosensitive member, and thereafter the charge transport layer and the charge generation layer of each piece were peeled off by chlorobenzene, methyl ethyl ketone and methanol, thereby exposing the electroconductive layer. A sample piece for observation was thus obtained, and five pieces thereof were prepared with respect to each electrophotographic photosensitive member.

First, one sample piece was used with respect to each electrophotographic photosensitive member, and the element ratio was analyzed by ESCA analysis in the same manner as described above.

It was confirmed that the electroconductive layer of each of electrophotographic photosensitive members C1 and C6 contained a titanium dioxide particle. It was confirmed that the electroconductive layer of each of electrophotographic photosensitive members C2 and C3 contained a titanium oxide particle containing an oxygen-deficient portion and nitrogen and having an X value of more than 0.6. It was confirmed that the electroconductive layer of electrophotographic photosensitive member C4 contained a titanium dioxide particle having an oxygen-deficient portion and no nitrogen. It was confirmed that the electroconductive layer of electrophotographic photosensitive member C5 contained a titanium dioxide particle where oxygen was substituted with nitrogen.

Subsequently, one sample piece was used with respect to each electrophotographic photosensitive member, to perform powder X-ray diffraction measurement. The presence or absence of a peak at a Bragg angle 2θ±0.1° of 43.1 to 43.2° in CuKα characteristic X-ray diffraction was the same as in a case where each particle was subjected to measurement.

Next, the remaining four sample pieces were used with respect to each electrophotographic photosensitive member, and the electroconductive layer of each electrophotographic photosensitive member was observed in the form of a three dimensional structure of 2 μm×2 μm×2 μm by Slice & View of FIB-SEM. The particle in the present invention could be identified from the difference in contrast in Slice & View of FIB-SEM, and the volume and the ratio in the electroconductive layer of the particle could be determined. The volume and the ratio in the electroconductive layer of the particle used in Comparative Examples could also be determined in the same manner. The conditions of Slice & View were as follows in the present invention.

Processing of sample for analysis: FIB method
Processing and observation apparatus: NVision 40 manufactured by SII/Zeiss
Slice interval: 10 nm
Observation conditions:
Accelerating voltage: 1.0 kV
Sample tilting: 54°
WD: 5 mm
Detector: BSE detector
Aperture: 60 μm, high current
ABC: ON
Image resolution: 1.25 nm/pixel The analytical region was 2 μm in length×2 μm in width, and the information on each cross section was summed up, to determine the volume V per unit of 2 μm in length×2 μm in width×2 μm in thickness ($V_T$=8 $\mu m^3$). The measurement environment was as follows: temperature: 23° C.; and pressure: $1\times10^{-4}$ Pa.

Herein, Strata 400S (sample tilting: 52°) manufactured by FEI Company could also be used as the processing and observation apparatus. Herein, the information on each cross section was obtained by image analysis of the area of the particle specified in the present invention or the particle used in Comparative Examples. The image analysis was performed using image analysis software: Image-Pro Plus manufactured by Media Cybernetics, Inc. Based on the resulting information, the volume (V [$\mu m^3$]) of the particle in the present invention or the particle used in Comparative Examples in a volume of 2 μm×2 μm×2 μm (unit volume: 8 $\mu m^3$) was determined with respect to each of the four sample pieces. Thus, the ((V [$\mu m^3$]/8 [$\mu m^3$])×100) was calculated. The average value of the volumes ((V [$\mu m^3$]/8 [$\mu m^3$])×100) of the four samples was defined as the content [% by volume] of the particle in the present invention or the particle used in Comparative Examples in the electroconductive layer relative to the total volume of the electroconductive layer.

The average primary particle size of the particle in the present invention or the particle used in Comparative Examples was determined with respect to each of the four sample pieces, as described above. The average value of the average primary particle sizes of the four sample pieces of the particle in the present invention or the particle used in Comparative Examples was defined as the average primary particle size ($D_1$) of the particle in the present invention or the particle used in Comparative Examples in the electroconductive layer. The results are shown in Table 4.

TABLE 4

| Electrophotographic photosensitive member | Coating liquid for electroconductive layer | X | Y | Presence or absence of X-ray diffraction peak | Average primary particle size ($D_1$) nm | Content of electroconductive material, % by volume | Thickness of electroconductive layer μm | Volume resistivity of electroconductive layer Ω · cm | Presence or absence of undercoat layer |
|---|---|---|---|---|---|---|---|---|---|
| 1 | 1 | 0.30 | 0.24 | Presence | 140 | 40% | 20 | $1.50 \times 10^{9}$ | Presence |
| 2 | 2 | 0.46 | 0.35 | Presence | 140 | 40% | 20 | $6.00 \times 10^{6}$ | Presence |
| 3 | 3 | 0.55 | 0.43 | Presence | 140 | 50% | 20 | $1.10 \times 10^{5}$ | Presence |
| 4 | 4 | 0.60 | 0.49 | Presence | 140 | 50% | 20 | $9.40 \times 10^{4}$ | Presence |
| 5 | 5 | 0.30 | 0.24 | Presence | 140 | 20% | 20 | $5.20 \times 10^{9}$ | Presence |
| 6 | 6 | 0.30 | 0.24 | Presence | 140 | 60% | 20 | $8.20 \times 10^{7}$ | Presence |
| 7 | 7 | 0.30 | 0.24 | Presence | 140 | 15% | 20 | $3.40 \times 10^{9}$ | Presence |
| 8 | 8 | 0.05 | 0.02 | Presence | 140 | 40% | 20 | $2.00 \times 10^{13}$ | Presence |
| 9 | 9 | 0.03 | 0.02 | Presence | 140 | 40% | 20 | $1.20 \times 10^{13}$ | Presence |
| 10 | 10 | 0.23 | 0.18 | Presence | 50 | 40% | 20 | $5.10 \times 10^{10}$ | Presence |
| 11 | 11 | 0.21 | 0.16 | Presence | 350 | 40% | 20 | $1.00 \times 10^{11}$ | Presence |
| 12 | 12 | 0.25 | 0.17 | Presence | 30 | 40% | 20 | $2.30 \times 10^{10}$ | Presence |
| 13 | 13 | 0.22 | 0.15 | Presence | 370 | 40% | 20 | $7.10 \times 10^{10}$ | Presence |
| 14 | 14 | 0.58 | 0.56 | Absence | 140 | 40% | 20 | $4.20 \times 10^{4}$ | Presence |
| 15 | 15 | 0.20 | 0.17 | Presence | 100 | 40% | 20 | $9.60 \times 10^{11}$ | Presence |
| 16 | 1 | 0.30 | 0.24 | Presence | 140 | 40% | 30 | $2.20 \times 10^{8}$ | Presence |
| 17 | 1 | 0.30 | 0.24 | Presence | 140 | 40% | 10 | $2.20 \times 10^{8}$ | Presence |
| 18 | 1 | 0.30 | 0.24 | Presence | 140 | 40% | 1 | $2.20 \times 10^{8}$ | Presence |
| 19 | 8 | 0.05 | 0.02 | Presence | 140 | 40% | 30 | $2.00 \times 10^{13}$ | Absence |
| 20 | 16 | 0.30 | 0.24 | Presence | 140 | 40% | 20 | $3.70 \times 10^{9}$ | Presence |
| 21 | 17 | 0.46 | 0.35 | Presence | 140 | 40% | 20 | $1.30 \times 10^{7}$ | Presence |
| 22 | 18 | 0.55 | 0.43 | Presence | 140 | 50% | 20 | $1.30 \times 10^{5}$ | Presence |
| 23 | 19 | 0.60 | 0.49 | Presence | 140 | 50% | 20 | $9.80 \times 10^{4}$ | Presence |
| 24 | 20 | 0.30 | 0.24 | Presence | 140 | 20% | 20 | $7.50 \times 10^{9}$ | Presence |
| 25 | 21 | 0.30 | 0.24 | Presence | 140 | 60% | 20 | $1.70 \times 10^{7}$ | Presence |
| 26 | 22 | 0.30 | 0.24 | Presence | 140 | 15% | 20 | $5.20 \times 10^{9}$ | Presence |
| 27 | 23 | 0.05 | 0.02 | Presence | 140 | 40% | 20 | $8.60 \times 10^{13}$ | Presence |
| 28 | 24 | 0.03 | 0.02 | Presence | 140 | 40% | 20 | $9.70 \times 10^{13}$ | Presence |
| 29 | 25 | 0.23 | 0.18 | Presence | 50 | 40% | 20 | $1.10 \times 10^{11}$ | Presence |
| 30 | 26 | 0.21 | 0.16 | Presence | 350 | 40% | 20 | $2.30 \times 10^{11}$ | Presence |
| 31 | 27 | 0.25 | 0.17 | Presence | 30 | 40% | 20 | $1.70 \times 10^{10}$ | Presence |
| 32 | 28 | 0.22 | 0.15 | Presence | 370 | 40% | 20 | $1.20 \times 10^{11}$ | Presence |
| 33 | 29 | 0.58 | 0.56 | Absence | 140 | 40% | 20 | $2.50 \times 10^{5}$ | Presence |
| 34 | 30 | 0.20 | 0.17 | Presence | 100 | 40% | 20 | $8.50 \times 10^{0}$ | Presence |
| 35 | 16 | 0.30 | 0.24 | Presence | 140 | 40% | 30 | $3.70 \times 10^{9}$ | Presence |
| 36 | 16 | 0.30 | 0.24 | Presence | 140 | 40% | 10 | $3.70 \times 10^{9}$ | Presence |
| 37 | 16 | 0.30 | 0.24 | Presence | 140 | 40% | 1 | $3.70 \times 10^{9}$ | Presence |
| 38 | 23 | 0.05 | 0.02 | Presence | 140 | 40% | 30 | $8.60 \times 10^{13}$ | Absence |
| X1 | X1 | 0.24 | 0.19 | Presence | 140 | 35% | 30 | $1.50 \times 10^{10}$ | Absence |
| X2 | X1 | 0.24 | 0.19 | Presence | 140 | 35% | 15 | $1.50 \times 10^{10}$ | Absence |
| X3 | X2 | 0.24 | 0.19 | Presence | 140 | 39% | 30 | $2.90 \times 10^{10}$ | Absence |
| X4 | X2 | 0.24 | 0.19 | Presence | 140 | 39% | 15 | $2.90 \times 10^{10}$ | Absence |
| C1 | C1 | 0.00 | 0.00 | Absence | 210 | 40% | 20 | $>1.0 \times 10^{14}$ | Presence |
| C2 | C2 | 0.83 | 0.71 | Absence | 100 | 40% | 20 | $4.50 \times 10^{5}$ | Presence |
| C3 | C3 | 0.85 | 0.65 | Absence | 60 | 40% | 20 | $1.30 \times 10^{5}$ | Presence |
| C4 | C4 | 0.14 | 0.00 | Absence | 360 | 40% | 20 | $9.40 \times 10^{6}$ | Presence |
| C5 | C5 | 0.55 | 0.55 | Absence | 250 | 40% | 20 | $6.20 \times 10^{6}$ | Presence |
| C6 | C1 | 0.00 | 0.00 | Absence | 210 | 40% | 30 | $>1.0 \times 10^{14}$ | Absence |

[Evaluation]

(Sheet feeding durability test of electrophotographic photosensitive member)

Each of electrophotographic photosensitive members 1 to 38, X1 to 2 and C1 to C6 for a sheet feeding durability test was mounted to a laser beam printer (trade name: LBP 7200C) manufactured by Canon Inc., and the sheet feeding durability test was performed under a low-temperature and low-humidity (15° C./10% RH) environment. In the sheet feeding durability test, a printing operation was performed in an intermittent mode where a character image with a printing ratio of 2% was output on a letter sheet one sheet by one sheet, thereby performing outputting 25000 sheets of the image. A sample for image evaluation (halftone image having a 1-dot Keima pattern) was output for one sheet at the initiation of the sheet feeding durability test and after completion of outputting 15000 and 25000 sheets of the image. The image evaluation criteria are as follows. The results are shown in Table 4.

A: No leakage occurred at all.

B: Leakage was slightly observed in the form of small black point.

C: Leakage was clearly observed in the form of large black point.

D: Leakage was observed in the forms of large black point and short lateral black streak.

E: Leakage was observed in the form of long lateral black streak.

(Evaluation of Definition of Image Printed by Electrophotographic Photosensitive Member)

The image density of each of electrophotographic photosensitive members 1 to 38, X1 to 2 and C1 to C6 was measured under a normal temperature and normal humidity (23° C./50% RH) environment according to the following, thereby performing evaluation of reproducibility of an isolated dot.

A laser beam printer (trade name: Color LaseJet Enterprise M552) manufactured by HP Development Company, L.P., which was altered, was used as the electrophotographic apparatus for evaluation. The laser beam printer was altered so as to be operated with the charging conditions and the amount of laser exposure being variable. The electrophotographic photosensitive member produced was mounted to a process cartridge for black and attached to the station of the process cartridge for black, and thus could be operated even when process cartridges for other colors (cyan, magenta, yellow) were not mounted to the main body of the laser beam printer. A potential probe (trade name: Model 6000B-8, manufactured by Trek Japan) mounted at the development position of the process cartridge was used for measurement of the surface potential of the electrophotographic photosensitive member, and the potential at the central portion in the longitudinal direction of the electrophotographic photosensitive member was measured using a surface potential meter (trade name: Model 344, manufactured by Trek Japan).

In image outputting, only the process cartridge for black was mounted to the main body of the laser beam printer, and a monochromatic image by only a black toner was output.

Figure 8:
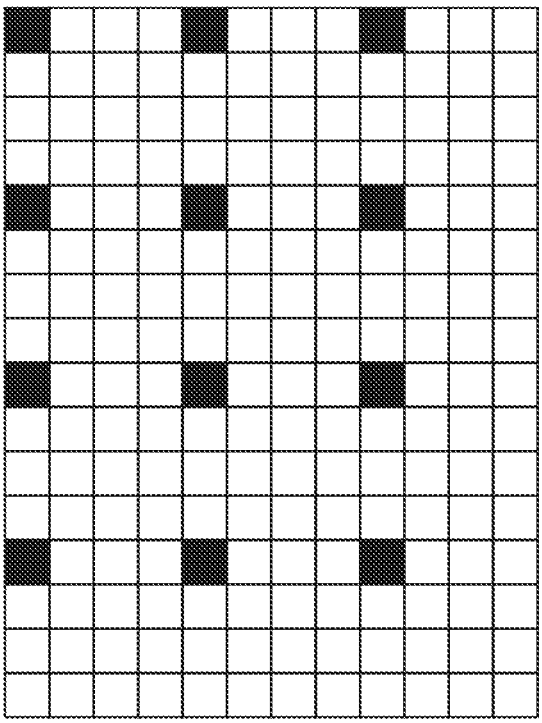
FIG. 8 is an image pattern used for image evaluation.

The evaluation image used was obtained by setting the charge potential Vd, the exposure potential V1 and the development potential Vcdc of the apparatus to −600 V, −200 V and −400 V, respectively, and outputting an image pattern (FIG. 8) where dots exposed were each arranged at three-dot intervals.

"REFLECTMETER MODEL TC-6DS" (manufactured by Tokyo Denshoku Co., Ltd.) was used for density measurement, and the density [%] was calculated from the difference between the degree of whiteness of a white background portion of the image printed, measured, and the degree of whiteness of a dot patch. An amber filter was used as the filter. In the present application, a density of the image printed, of 8.0% or more, was defined as a standard where an isolated dot exposed could be clearly reproduced.

The results are shown in Table 5.

TABLE 5

| Example | Leakage test: At initiation of sheet feeding durability test | Leakage test: After completion of outputting 15000 sheets of image | Leakage test: After completion of outputting 25000 sheets of image | Image density of isolated dot % |
|---|---|---|---|---|
| 1 | A | A | A | 10.4 |
| 2 | A | A | B | 11.1 |
| 3 | A | B | B | 11.7 |
| 4 | A | B | C | 12.1 |
| 5 | A | A | A | 10.4 |
| 6 | A | B | B | 10.2 |
| 7 | A | A | A | 8.3 |
| 8 | A | A | A | 9.3 |
| 9 | A | A | A | 8.1 |
| 10 | A | A | B | 10.2 |
| 11 | A | B | B | 10.3 |
| 12 | A | A | B | 10.0 |
| 13 | A | B | B | 10.5 |
| 14 | A | B | C | 11.9 |
| 15 | A | A | A | 10.3 |
| 16 | A | A | A | 11.0 |
| 17 | A | A | A | 10.3 |
| 18 | A | A | B | 10.2 |
| 19 | A | B | B | 9.4 |
| 20 | A | A | A | 10.1 |
| 21 | A | A | B | 10.8 |
| 22 | A | B | B | 11.3 |
| 23 | A | B | C | 11.5 |
| 24 | A | A | A | 10.1 |
| 25 | A | B | B | 10.2 |
| 26 | A | A | A | 8.1 |
| 27 | A | A | A | 9.1 |
| 28 | A | A | A | 8.0 |
| 29 | A | A | B | 10.1 |
| 30 | A | B | B | 9.9 |
| 31 | A | A | B | 10.0 |
| 32 | A | B | B | 10.3 |
| 33 | A | B | C | 11.8 |
| 34 | A | A | A | 9.5 |
| 35 | A | A | A | 10.9 |
| 36 | A | A | A | 10.2 |
| 37 | A | A | B | 9.8 |
| 38 | A | B | B | 9.4 |
| X1 | A | B | B | 9.4 |
| X2 | A | B | B | 9.1 |
| X3 | A | B | B | 10.1 |
| X4 | A | B | B | 9.9 |

| Comparative Example | Leakage test: At initiation of sheet feeding durability test | Leakage test: After completion of outputting 15000 sheets of image | Leakage test: After completion of outputting 25000 sheets of image | Image density of isolated dot |
|---|---|---|---|---|
| C1 | A | A | A | 4.1 |
| C2 | C | C | D | 12.4 |
| C3 | C | C | D | 12.2 |
| C4 | B | C | C | 8.1 |
| C5 | B | C | C | 8.5 |
| C6 | A | A | B | 5.3 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-037015, filed Feb. 28, 2017, which is hereby incorporated by reference herein in its entirety.

What is claimed is:

1. An electrophotographic photosensitive member comprising a support, an electroconductive layer and a photosensitive layer in this order, wherein the electroconductive layer comprises a binder material and a particle represented by general formula (1):

$$TiO_{2.00-X}N_Y \quad (1)$$

wherein Ti represents a titanium atom, O represents an oxygen atom, N represents a nitrogen atom and $0.00<Y<X\leq 0.60$ is satisfied.

2. The electrophotographic photosensitive member according to claim 1, wherein the particle has a peak at a Bragg angle $2\theta\pm 0.1°$ of 43.1 to 43.2° in CuKα characteristic X-ray diffraction.

3. The electrophotographic photosensitive member according to claim 1, wherein $0.05Y<X\leq 0.30$ is satisfied in the general formula (1).

4. The electrophotographic photosensitive member according to claim 1, wherein an average primary particle size of the particle is 50 nm or more and 350 nm or less.

5. The electrophotographic photosensitive member according to claim 1, wherein a volume resistivity of the electroconductive layer is $1.0\times 10^5$ Ω·cm or more and $5.0\times 10^{12}$ Ω·cm or less.

6. The electrophotographic photosensitive member according to claim 1, wherein a content of the particle is 20% by volume or more and 50% by volume or less based on a total volume of the electroconductive layer.

7. The electrophotographic photosensitive member according to claim 1, wherein a powder resistivity of the particle is $2.0\times10^{1}$ Ω·cm or more.

8. A process cartridge that integrally supports an electrophotographic photosensitive member comprising a support, an electroconductive layer and a photosensitive layer in this order, and at least one unit selected from a charging unit, a developing unit, a transfer unit and a cleaning unit, and that is detachably mountable on a main body of an electrophotographic apparatus, wherein the electroconductive layer comprises a binder material and a particle represented by general formula (1):

$$TiO_{2.00-X}N_Y \quad (1)$$

wherein Ti represents a titanium atom, O represents an oxygen atom, N represents a nitrogen atom and $0.00<Y<X\leq0.60$ is satisfied.

9. An electrophotographic apparatus comprising: an electrophotographic photosensitive member comprising a support, an electroconductive layer and a photosensitive layer in this order; and a charging unit, an exposure unit, a developing unit and a transfer unit, wherein the electroconductive layer comprises a binder material and a particle represented by general formula (1):

$$TiO_{2.00-X}N_Y \quad (1)$$

wherein Ti represents a titanium atom, O represents an oxygen atom, N represents a nitrogen atom and $0.00<Y<X\leq0.60$ is satisfied.

* * * * *